US006029286A

United States Patent [19]

Funk

[11] Patent Number: 6,029,286

[45] Date of Patent: Feb. 29, 2000

[54] ODOR REMOVING APPARATUS FOR TOILETS

[76] Inventor: Cameron Funk, 12725 Greenvalley Dr., Oklahoma City, Okla. 73120

[21] Appl. No.: 09/078,783

[22] Filed: May 14, 1998

[51] Int. Cl.[7] ..... E03D 9/02

[52] U.S. Cl. ..... 4/223

[58] Field of Search ..... 4/223

[56] References Cited

U.S. PATENT DOCUMENTS

| | | | |
|---|---|---|---|
| 3,088,125 | 5/1963 | Southwood | 4/222 |
| 3,336,603 | 8/1967 | Leland | 4/223 |
| 3,420,445 | 1/1969 | Inzerill | 4/223 X |
| 3,999,225 | 12/1976 | Ables | 4/213 |
| 4,153,956 | 5/1979 | Fischer, Sr. et al. | 4/213 |
| 4,183,105 | 1/1980 | Womack | 4/223 X |
| 4,358,860 | 11/1982 | Church | 4/228.1 |
| 4,433,441 | 2/1984 | Schroeder | 4/213 |
| 4,633,533 | 1/1987 | Meehan | 4/222 |
| 4,670,916 | 6/1987 | Bloom | 4/231 |
| 4,701,966 | 10/1987 | Schafer | 4/213 |
| 4,873,729 | 10/1989 | Micallef | 4/233 |
| 5,010,600 | 4/1991 | Prisco | 4/217 |
| 5,031,259 | 7/1991 | Baiera et al. | 4/661 |
| 5,125,119 | 6/1992 | Munoz | 4/213 |
| 5,199,111 | 4/1993 | Antepenko | 4/213 |
| 5,457,822 | 10/1995 | Klammsteiner | 4/223 |
| 5,530,971 | 7/1996 | Anderson | 4/215 |

*Primary Examiner*—Robert M. Fetsuga
*Attorney, Agent, or Firm*—Robert Treece

[57] ABSTRACT

An apparatus for delivering an odor reducing chemical to a toilet bowl comprising a pressurized source of odor reducing chemical, a valve communicatively connected to the pressurized source of odor reducing chemicals for selectively releasing odor reducing chemical from the pressurized source, a button located at a location remote from said pressurized source of odor reducing chemical for opening said valve when activated by user, wherein said activating means may be selectively activated one or more times by the user either before, after or while the user is seated on the toilet, a bracket for mounting on a toilet bowl, and a spray nozzle.

3 Claims, 3 Drawing Sheets

ODOR REMOVING APPARATUS FOR TOILETS

BACKGROUND OF THE INVENTION

1. Field of the Invention

The present invention relates to attachment assemblies for existing bathroom toilets to eliminate odor before, during, and after use. The device, when activated either manually on the outside of the bowl or with a remote control placed in a preferred location in the bathroom, produces a fine mist of a odor eliminating fluid into the toilet bowl and away from the user whenever the user desires. The device has a replaceable pressurized reservoir of odor eliminating fluid that may be hidden behind the toilet, a small inconspicious delivery system that is easy to install or remove for cleaning, and an activation mechanism that can be placed, for example, by the toilet paper dispenser, or wherever else desired in the bathroom. This invention will give the user of the toilet a choice of when and how often to deodorize without the limitations of the prior art.

2. Description of the Prior Art

In the past, bathroom deodorizers were either aerosol spray cans or large, cumbersome, and relatively expensive systems that required many parts, modification of the toilet, or external power sources. Spray cans were cheap and easy to use, but could not be applied at the source of the odor, the toilet bowl, while the toilet was in use. This problem limited the effectiveness of aerosol spray cans and spurned the development of other more complex systems which either vented the toilet bowl, introduced deodorant into the toilet bowl, or a combination of both.

The prior art of venting of the escaped odor required elaborate external exhausts, fans, and power systems. Furthermore, actual venting of the toilet bowl before the odor escaped often required modification of the toilet seat or unsightly and possibly unsanitary placement of air vacuum equipment in the toilet bowl. These systems were not easily installed or removed for cleaning and could become quite expensive.

Likewise, the prior art of deodorant delivery systems into the toilet bowl were limited by complexity and its associated cost to effectively stop odor before leaving the toilet bowl. Much of the prior art required modification to the standard toilet, unfavorable external power sources for the use near water in bathrooms, or made cleaning the toilet difficult by current standards. These systems were also relatively expensive when external power sources were needed to operate the device.

Many of the simpler less expensive deodorant delivery systems that didn't require external power sources were ineffective due to the activation methods. Many used the force supplied by the toilet user to activate the deodorant. This was accomplished by either the sitting motion on the toilet seat or rising motion of the user off of the seat as a source to activate the deodorant delivery system. Hence, these activation apparatuses sometimes produced deodorant regardless of the users desire or without a way for the user to decide when and how often to activate the system.

Notwithstanding the potential of these prior attempts to solve the bathroom odor problem, no fully adequate and commercially acceptable solution has been found. This fact is clearly evident by surveying current residential and commercial bathrooms.

SUMMARY OF THE INVENTION

In view of the foregoing disadvantages inherent in the known methods of odor removing apparatuses for toilets now present in the prior art, the present invention provides an improved construction wherein the same can be utilized in those situations where the prior art was limited. As such, the general purpose of the present invention, which will be described subsequently in greater detail, is to provide a new and improved odor removing apparatus for toilets which has all the advantages of the prior art devices and none of the disadvantages.

To attain this, the present invention essentially comprises a replaceable pressurized reservoir of odor eliminating fluid that may be hidden behind the toilet, a small inconspicious delivery system that is communicatively connected to the source of odor eliminating fluid and a spray nozzle which is easy to install or remove for cleaning. An activation mechanism is conveniently located to allow the user to choose when and how often to release the odor eliminating fluid, and the activation mechanism may be wireless so it can be placed, for example, by the toilet paper dispenser, or wherever else desired in the bathroom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved odor removing apparatus for modern bathroom toilets which may be easily and efficiently manufactured and marketed.

It is a further object of the present invention to provide a new and improved odor removing apparatus for toilets which is of a durable and reliable construction.

An even further object of the present invention is to provide a new and improved odor removing apparatus for toilets which is susceptible of a low cost of manufacture with regard to both materials and labor, and which accordingly is then susceptible of low prices of sale to the consuming public, thereby making such apparatus economically available to the buying public.

Still another object of the present invention is to provide a new and improved odor removing apparatus for toilets which provides some of the advantages of the prior art, while simultaneously overcoming some of the disadvantages normally associated therewith.

Another object of the present invention is to provide a new and improved odor removing apparatus for toilets that is easily and quickly affixed to existing in place toilets without modification to the actual toilet.

Yet another object is to allow an activation system that can be placed, for example, next to the toilet paper dispenser or any other desired location in the bathroom.

And another object is to allow an inexpensive pressurized fluid reservoir cannister that is easy to install and replace when empty.

Still another object is to allow the toilet user to activate the apparatus whenever they chose, as often they choose, or not to activate the apparatus at all if they so choose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
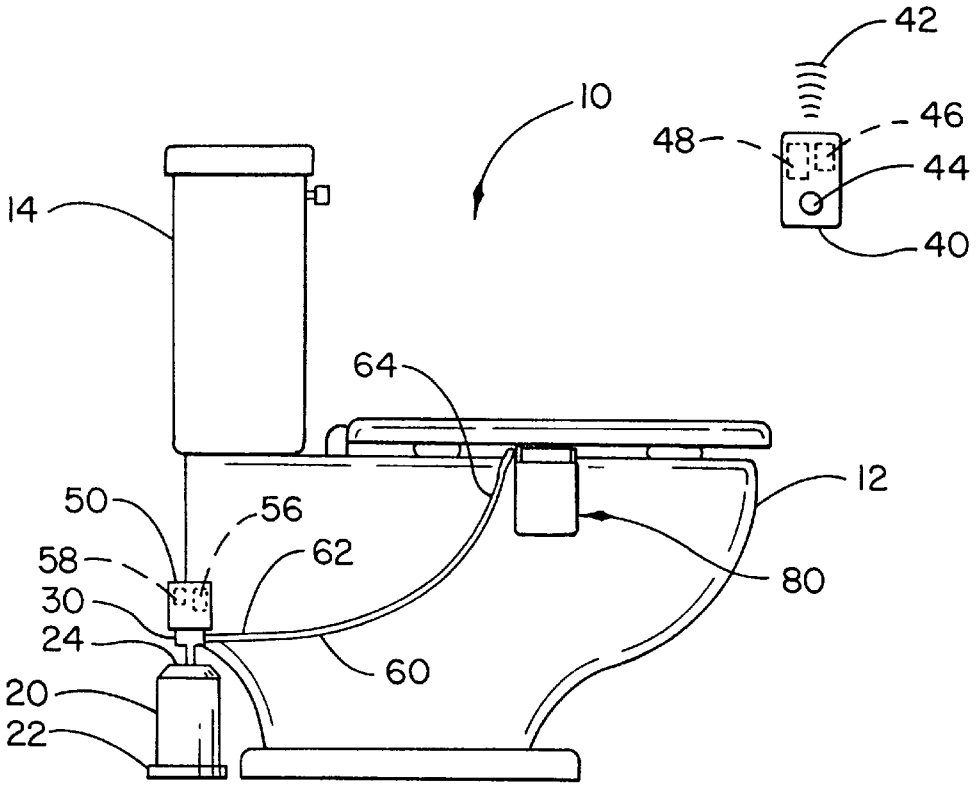
FIG. 1 is a side view of a preferred embodiment of the invention attached to a toilet.
Figure 2:
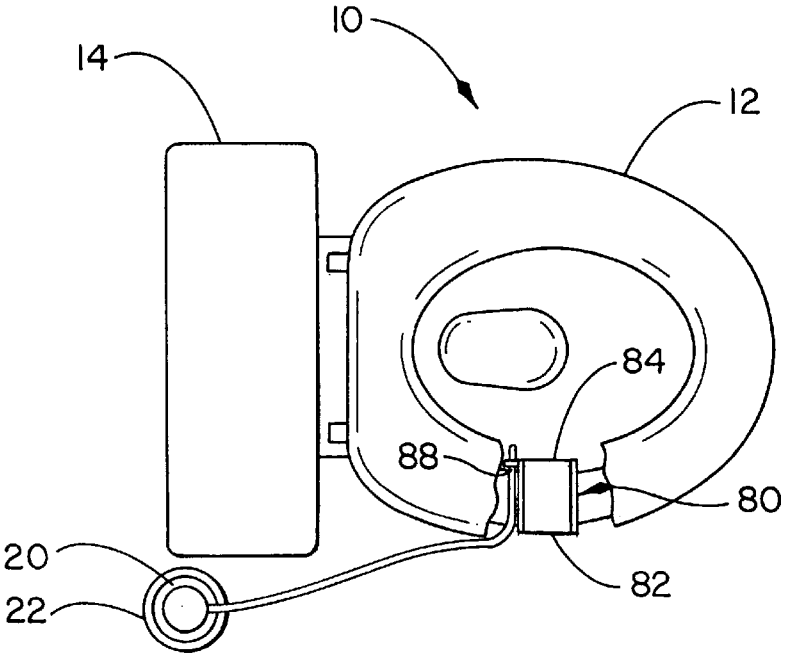
FIG. 2 is an overhead view of a preferred embodiment of the invention attached toilet.

Referring to the drawing in detail and to FIG. 1. and FIG. 2 in particular, reference character 10 generally designates an odor removing apparatus for toilets constructed in accordance with the present invention.

Figure 3:
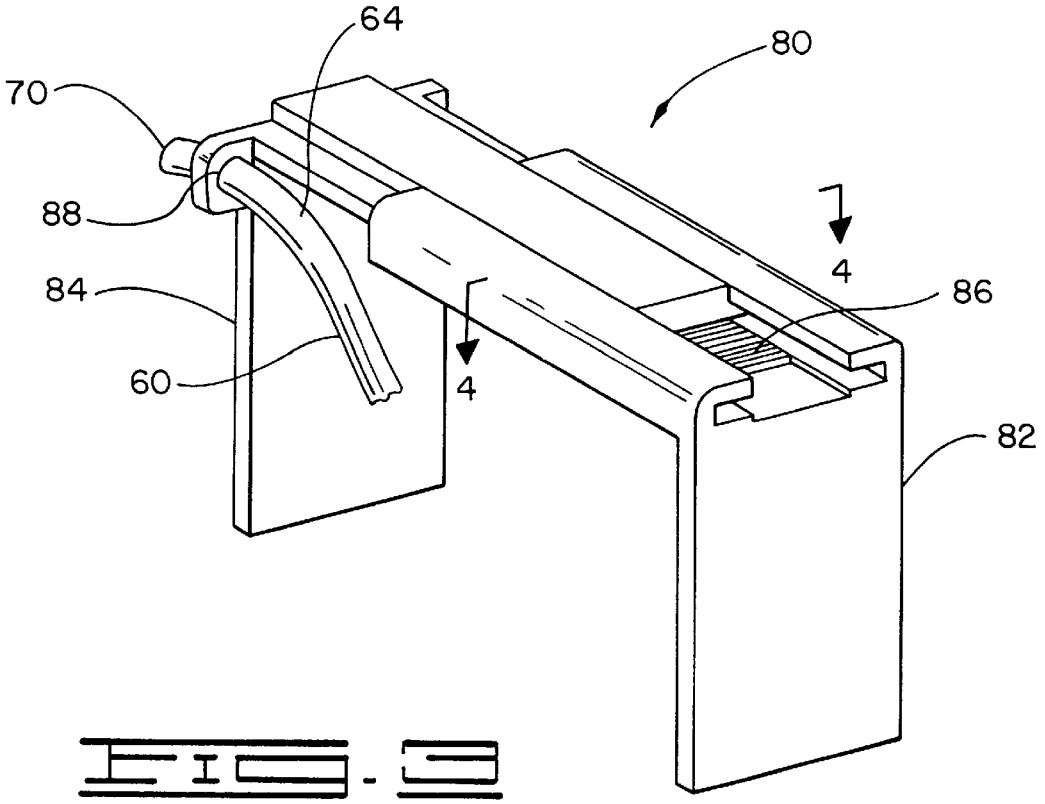
FIG 3. is a perspective view of a bracket assembly for the invention of FIG. 1 and FIG. 2.

Referring to all the drawings and FIG.1, FIG. 2, and FIG. 3 in particular, the odor removing apparatus 10 is removably attached to toilet bowl 12 of generally standard toilet 14.

A container of odor reducing chemical 20 is placed behind the toilet bowl 12 out of the vision of the user. A preferred embodiment would have a container stand 22 located on the floor behind the toilet 14. Preferably this container stand 22 would be generally donut shaped with a recessed area in the middle for removably attaching to the container 20 so as to provide a larger base for the container 20. In one preferred embodiment, the container stand 22 would be made from dense material to provide weight. Some materials for the manufacturing of the stand include, but are not limited to, plastic, stainless steel, cast iron or the like to reduce tipping and increase stability when the container 20 is nearly empty. A preferred embodiment of the container 20 is a pressurized aerosol can having an opening at the top 24. The top of the container 20 may include threads, a lip, or the like.

Figure 6:
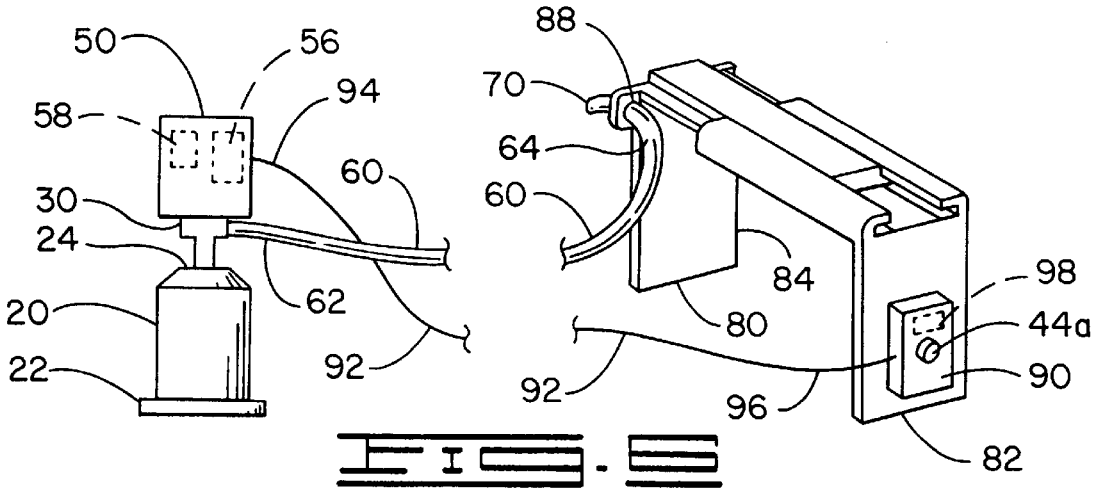
FIG. 6 is a perspective view showing a hard wired remote activation means for the current invention.
Figure 7:
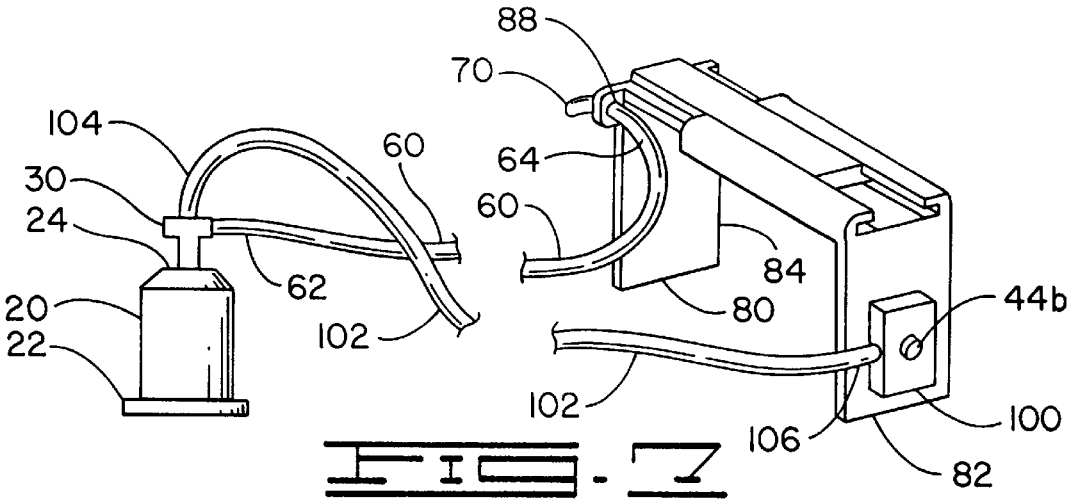
FIG. 7 is a perspective view showing a mechanical connection activation means for the current invention.

Referring to all the drawings and FIG. 1, FIG. 6, and FIG.7 in particular, the container 20 is removably attached to a valve unit 30 with a preferred embodiment being but not limited to a screw mechanism, pressure fit, or the like, between the top 24 of the container 20 and the valve unit 30. The screw type attachment may be accomplished with a container having threads on the top of the container 20 and mating threads provided on the bottom of the valve unit 30. In this way, the valve unit 30 may be screwed onto the container 20. With a pressure fit type attachment, the base of the valve unit 30 acts as a plug which may be pushed into a collar on the top 24 of the container 20. With the valve unit 30 frictionally engaging the collar on the container 20 to form a seal between the valve unit 30 and the container 20. Other suitable connecting devices between the container 20 include clamping connections and the like. With One preferred embodiment of valve unit 30 would generally consist of a needle, pin, or the like that would generally open the top 24 of the container 20 when the valve unit 30 is attached onto the top 24 of the container 20. The needle, pin or the like may be a solid piece, and allow material from the container to escape around the pin and into the valve unit 30, or may be hollow allowing material in the container to escape through the pin and into the valve unit 30.

The valve unit 30 should be connected to a conduit 60 having a first end 62 and a second end 64. A preferred embodiment of the conduit 60 would be a flexible hose made from plastic, rubber or the like, however, a stiffer material such a copper or aluminum may also be used. The first end 62 of the conduit 60 is attached to the valve unit 30 with a preferred embodiment being a pressure fit, screw mechanism, or the like. While the conduit is preferably removably attached it may be permanently attached and may even be integral with the valve unit 30.

The second end 64 of the conduit 60 is attached to a spray head nozzle 70 leading into the inner area of the toilet bowl 12, and may be either permanently attached or removably attached. A preferred embodiment of the spray head nozzle 70 include but are not limited to plastic, stainless steel, brass, or the like. A preferred embodiment of connecting spray head nozzle 70 to the second end 64 of conduit 60 would be, but not be limited to, a pressure fit, screw mechanism, or the like.

Figure 4:
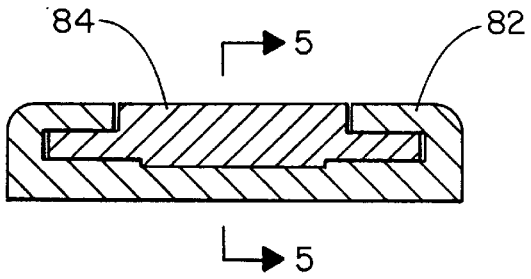
FIG. 4 is a sectional view taken along line 4—4 of FIG. 3.
Figure 5:
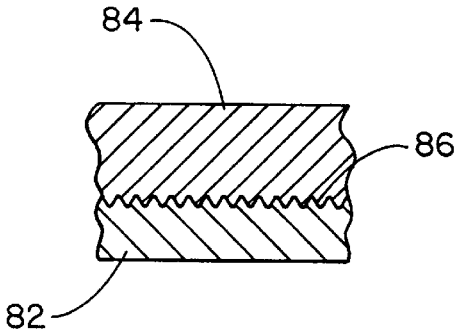
FIG. 5 is a sectional view taken along line 5—5 of FIG. 4.

Referring to the drawings and FIG.3, FIG. 4, and FIG. 5 in particular the second end 64 of the conduit 60 with the spray head nozzle 70 would removably attach to a bracket 80. The spray nozzle preferably being made of a durable material including but not limited to plastic or metal such as stainless steel or brass.

Bracket 80 is removably attached to the toilet bowl 12 rim. A preferred embodiment of the bracket 80 includes an outer bracket leg 82 and an inner bracket leg 84. Outer bracket leg 82 and inner bracket leg 84 would removably connect together with a preferred embodiment being interlocking adjustable tooth arrangements 86 which would allow the outer bracket leg 82 and the inner bracket leg 84 to snap together tightly trapping the toilet bowl 12 rim. The inner bracket leg 84 that sits inside the toilet bowl 12 has an aperture 88 which would allow the conduit 60 and/or the spray head nozzle 70 to be removably attached to the bracket 80. This would allow the installer to direct where in the toilet bowl 12 the odor reducing chemical would spray and provide stability when conduit 60 discharges. Preferably the spray would discharge away from the user.

The apparatus also includes an activation means which may be selectively activated at the user's discretion. Thus, the user may choose not to activate the device at all, or activate the device one or more times when desired. In general the user need only press a button, or pull a lever and a fine mist of odor eliminating fluid is released into the toilet bowl. Some suitable activation means include, a remote wireless activation means, a hard wired activation means, a remote mechanical activation means, and an in-line valve activation means.

Remote Wireless Signal Activation Means

Referring again to the drawings and FIG. 1 in particular, a preferred embodiment of the invention 10 includes but is not limited to an electromagnetic communication between a wireless remote activator 40 and the valve unit 30. The wireless remote activator 40 generally consist of a remote push button 44 with a power supply such as but not limited to a battery unit 46 that would send a signal 42 such as but not limited to an electromagnetic wave to a signal receiver 50 attached to the valve unit 30. A preferred embodiment would have a plastic housing for the wireless remote activator 40 with a push button 44, electronic device 48 which generates a signal 42, and the battery 46 to power the electrical device 48. The wireless remote activator 40 may have means for removably attaching the housing to surfaces such as, but not limited, to the bracket 80, the side of the toilet bowl 12, a wall near the toilet 14, a toilet paper dispenser near the toilet 14, or a light switch near the toilet 14. While the wireless remote activator 40 could be mounted anywhere generally near the toilet, it should be within the reach of an individual from the toilet so the apparatus may be selectively activated therefrom. Preferred embodiments for the means to removably attach remote activator 40 include but are not limited to velcro, screws, adhesive tape, and hooks or other similar fastening devices.

The valve unit 30 is attached to a receiver 50 that would receive the signal 42 from a wireless remote activator 40. The receiver 50 generally consist of a second electronic device 58, and a power supply such as a battery 56 that would open and close the valve unit 30. A preferred embodiment of the second electrical device 58 includes but is not limited to, a solenoid switch. The receiver 50 may have a housing made from any suitable material, but a plastic housing is preferred.

Hard Wired Remote Signal Activation Means

Referring again to the drawings and FIG. 6 in particular, another preferred embodiment of the invention's activation means is a hard wired remote signal activation means. With this means, an electronic signal from a wired activator 90 passes to the receiver 50 through one or more wires connected to both the activator 90 and the receiver 50. The receiver may be removably connected to valve unit 30. The wired activator 90 would generally consist of a remote push button 44a that would open and close a circuit 98 to the receiver 50 by electrical wiring 92 having a fist end 94 and a second end 96. The electrical wiring first end 94 is connected to receiver 50 and electrical wiring second end 96 is connected to the wired activator 90. When the button 44*a* is pressed an electrical signal would be generated by the activator 90 and pass through the wiring 92 to the receiver 50. Upon receiving the signal the receiver would cause the valve unit 30 to release odor eliminating fluid to pass from the container 20 through the conduit 60 and out through the spray head nozzle 70.

As with the other components, the activator 90 may be made from any suitable material, but preferably the housing is formed from a moldable material such as plastic. The wired activator 90 may have a means for removably attaching the housing to surfaces near the toilet, such as but not limited, to the bracket 80, the side of the toilet bowl 12, a wall near the toilet 14, a toilet paper dispenser near the toilet 14, or a light switch near the toilet 14. Some preferred means for removably attaching wired activator 90 to surfaces near the toilet include, but are not limited to, velcro, screws, adhesive tape, and hooks and the like.

Mechanical Connection Activation Means

Referring again to the drawings and FIG. 7 in particular, another preferred embodiment of the invention 10 is a physical communication from the mechanical activator 100 to valve unit 30. A preferred embodiment of the mechanical activator 100 generally consist of a sleeved push rod 102 with a first end 104 and a second end 106, and a push button 44*b*. The sleeved push rod first end 104 is attached to valve unit 30 and sleeved push rod second end 106 connects to the push button 44B on the mechanical activator 100.

An embodiment of the mechanical activator 100 has means for removably attaching the housing to surfaces such as but not limited to the bracket 80, the side of the toilet bowl 12, a wall near the toilet 14, a toilet paper dispenser near the toilet 14, or a light switch near the toilet 14. However, with this embodiment it is the activator is secured to the bracket 80 or the side of the toilet bowl 12 so the sleeved push rod may be generally concealed. Some preferred means for removably attaching the mechanical activator 100 include, but are not limited to, velcro, screws, adhesive tape, and hooks.

In-line Valve Activation Means

Figure 8:
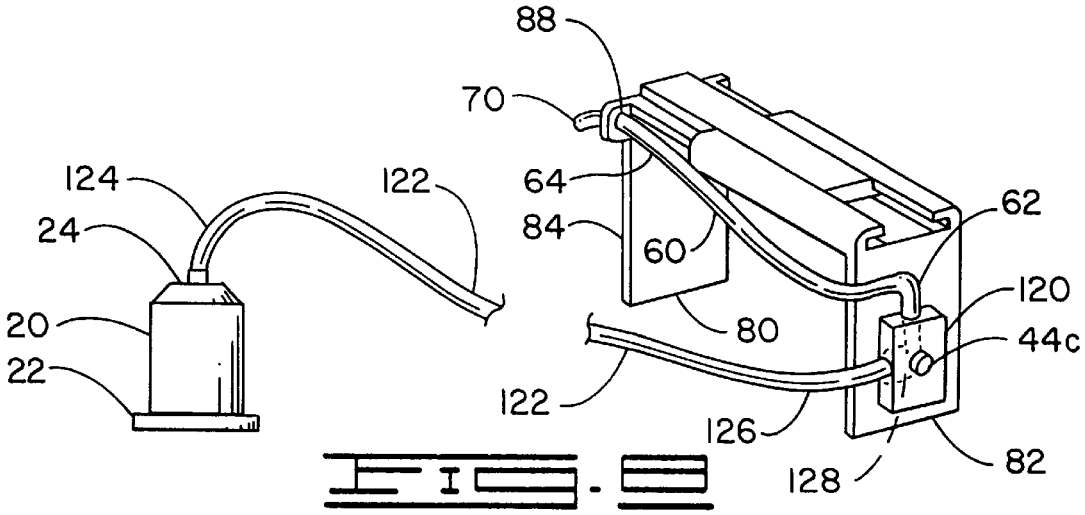
FIG. 8 is a perspective view of an in-line valve activation means for the current invention.

Referring again to the drawings and FIG. 8 in particular, another preferred embodiment of invention 10 is an in-line valve unit activator 120 generally having feed line 122 with a first end 124 and a second end 126, and in-line valve 128.

The feed line first end 124 is removably connected to the container 20 such as by, but not limited to, a screw mechanism, pressure fit, or the like, between the top 24 of the container 20 and the feed line first end 124. A needle, pin, or the like is attached to feed line first end 124 to open the top 24 of container 20 when the feed line first end 124 is attached to the top 24 of container 20. Feed line second end 126 is attached to the in-line valve 128 with a preferred embodiment being but not limited to a screw mechanism, pressure fit, clamp or the like.

The first end 62 of the conduit 60 is attached to the in-line valve unit 128 with a preferred attachment means being a pressure fit. The second end 64 of the conduit 60 is attached to a spray head nozzle 70 leading into the inner area of the toilet bowl 12. In this way, when the button 44*c* is pressed, odor eliminating fluid is released from the conduit 122 (and the container 20), through conduit 60 and out through spray head 70.

OPERATION

In operation, the invention allows the user to determine when and how often to activate the apparatus by providing a button or the like to activate the apparatus. The device is activated by depressing the button 44, 44*a*, 44*b*, or 44*c* depending on the activation means provided. This opens the valve and releases odor eliminating fluid from the pressurized container 20. The fluid travels through the conduit and is then dispersed into the toilet bowl 12 through the spray head nozzle 70. After the desired amount of fluid is dispersed, the user then stops depressing the button 44 which closes valve. The user may, at their discretion dispensing odor eliminating fluid before, during or after using the toilet. In addition, the user may choose to dispense multiple times or not at all.

I claim:

1. An apparatus for delivering an odor reducing chemical to toilet having a toilet bowl comprising:

a pressurized source of odor reducing chemical;

a valve communicatively connected to the pressurized source of odor reducing chemical for selectively releasing odor reducing chemical from the pressurized source;

activating means located at a location remote from said pressurized source of odor reducing chemical for opening said valve when activated by a user, wherein said activating means may be selectively activated one or more times by the user either before, after or while the user is seated on the toilet;

a spray nozzle communicatively connected to said valve for transporting odor reducing chemical from said valve to said spray nozzle;

a bracket for mounting on a toilet bowl and for holding said spray nozzle in a position to direct odor reducing chemical into the toilet bowl;

wherein the source of the odor reducing chemical is an aerosol can containing pressurized chemical, the valve is connected to said aerosol can, and wherein the activating means includes a button with the means for communicating with said valve and for remotely activating said valve to allow odor reducing chemical to flow from the can to the spray nozzle; and wherein the button is connected to the bracket.

2. The apparatus of claim 1, wherein the bracket comprises two interlocking adjustable tooth arrangements to attach to the toilet bowl.

3. The apparatus of claim 1, wherein the pressurized source of odor reducing chemical is placed in a holder.

* * * * *